United States Patent [19]

Chester

[11] 4,416,271

[45] Nov. 22, 1983

[54] SPINAL MISALIGNMENT DETECTIVE AND CORRECTIVE APPARATUS

[76] Inventor: Kern E. Chester, 104 Academy Dr., Paragould, Ark.

[21] Appl. No.: 312,164

[22] Filed: Oct. 16, 1981

[51] Int. Cl.[3] ..... A61H 15/00

[52] U.S. Cl. ..... 128/57; 272/900

[58] Field of Search ..... 128/57, 60, 67; 254/251, 252; 269/236, 86, 87, 89, 90, 95, 97, 237, 154; 24/263 B, 248, 273, 271, 69 TS, 69 R, 328, 134 L, 132 WL; 272/127, 900, 69; 273/29 BC; 411/344

[56] References Cited

U.S. PATENT DOCUMENTS

| | | | |
|---|---|---|---|
| 53,738 | 4/1866 | Jones | 269/95 X |
| 60,091 | 11/1866 | Tice | 269/236 |
| 711,068 | 10/1904 | McMahon et al. | 269/95 X |
| 1,533,528 | 4/1925 | Weaver . | |
| 1,560,549 | 11/1925 | Duncan . | |
| 1,572,794 | 2/1926 | Hamilton | 128/57 |
| 1,872,491 | 8/1932 | Noetzel | 24/263 B |
| 2,328,156 | 8/1943 | London | 128/25 B |
| 2,466,470 | 4/1949 | Norris . | |
| 2,619,957 | 12/1952 | Hague . | |
| 2,819,714 | 1/1958 | London | 128/57 |
| 2,920,370 | 1/1960 | Guy | 24/271 |
| 3,120,953 | 2/1964 | London | 128/57 |
| 3,577,985 | 5/1971 | Guffin . | |
| 3,616,794 | 11/1971 | Gromala | 128/57 |
| 3,970,078 | 7/1976 | Rogers, Jr. | 128/57 |

FOREIGN PATENT DOCUMENTS

| | | | |
|---|---|---|---|
| 59568 | of 1947 | Netherlands | 269/90 |

OTHER PUBLICATIONS

"Hill Anatomotor", *The Digest of Chiropractic Economics,* p. 117, Jan./Feb., 1978.

"MA-Roller", *The Digest of Chiropractic Economics,* p. 111, Jan./Feb., 1978.

"Spinalator", *The Digest of Chiropractic Economics,* p. 124, Nov./Dec., 1980.

"Kyroflex", Brochure from the Kyro Manufacturing Company.

*Primary Examiner*—Richard J. Apley
*Assistant Examiner*—David J. Brown
*Attorney, Agent, or Firm*—Emch, Schaffer & Schaub

[57] ABSTRACT

This invention is a spinal misalignment detective and corrective apparatus for the back. The invention is mounted on a vertically extending member such as a door jam and includes a base member with two wheels mounted for rotation on a horizontal axis. Connected to the base member are support arms for removably holding the apparatus to the door jam. Such operative connection is achieved through a clamping mechanism which urges the support arms into a holding position relative to the door jam.

12 Claims, 4 Drawing Figures

SPINAL MISALIGNMENT DETECTIVE AND CORRECTIVE APPARATUS

BACKGROUND OF THE INVENTION

This invention relates to certain new and useful improvements for devices used to treat ailments of the spine. More particularly, the invention relates to a highly effective device with a unique engaging means which can be used by an ailing person, without the aid of another, for relieving spinal nerve interference or other spinal problems.

In the past, the devices available for relieving back pain have been free standing, attached to a door, attached to a wall, or used on the floor. For example, Weaver U.S. Pat. No. 1,533,528 shows a device having a roller attached through a semiflexible member to end handles. Hague Pat. No. 2,619,957 shows a portable spinal massage device which may be placed on the floor and lain upon by the user. The London Pat. Nos. 2,328,156 and 2,819,714 show a massage apparatus which is mounted on a conventional door. Guffin U.S. Pat. No. 3,577,985 shows a massaging and washing device having rollers which are attached to a wall with suction cups.

The present invention permits a person to detect spinal misalignments by him or herself. In their normal state the muscles on either side of the spine are in balance. However, when a spinal misalignment occurs the muscles are in a state of imbalance. On the side where the transverse misalignment is more prominent there will be soreness or pain elicited by light pressure. This soreness is the result of the orgin and insertion of the rotation muscles being held in a stretched position.

One purpose of the apparatus according to this invention is to balance and align the spine. This is accomplished by the use of wheels or rollers which straddle the spinous processes of the spinal column and are rolled over the transverse processes. Both wheels project outwardly the same distance from the base of the apparatus. Therefore more pressure will be brought to bear on the more prominent transverse process. This pressure pushes the prominent transverse toward its proper alignment. It also removes the stretch from the muscles involved, allowing them to regain their normal tonus, and to be in balance.

A spine that is balanced and aligned correctly will be free of soreness or pain.

In addition, due to the novel clamping mechanism the apparatus can be attached to a conventional door jam. Should the user want to check any area of the spine, the height of the apparatus can be easily adjusted by the clamping mechanism.

It has been found that a vertically adjustable apparatus which can be used by the individual alone, without force being applied by another, provides a more accurate and specific method for checking the spine for misalignments. The present invention provides a scientific method for correcting these misalignments safely.

DESCRIPTION OF THE PREFERRED EMBODIMENT

Figure 1:
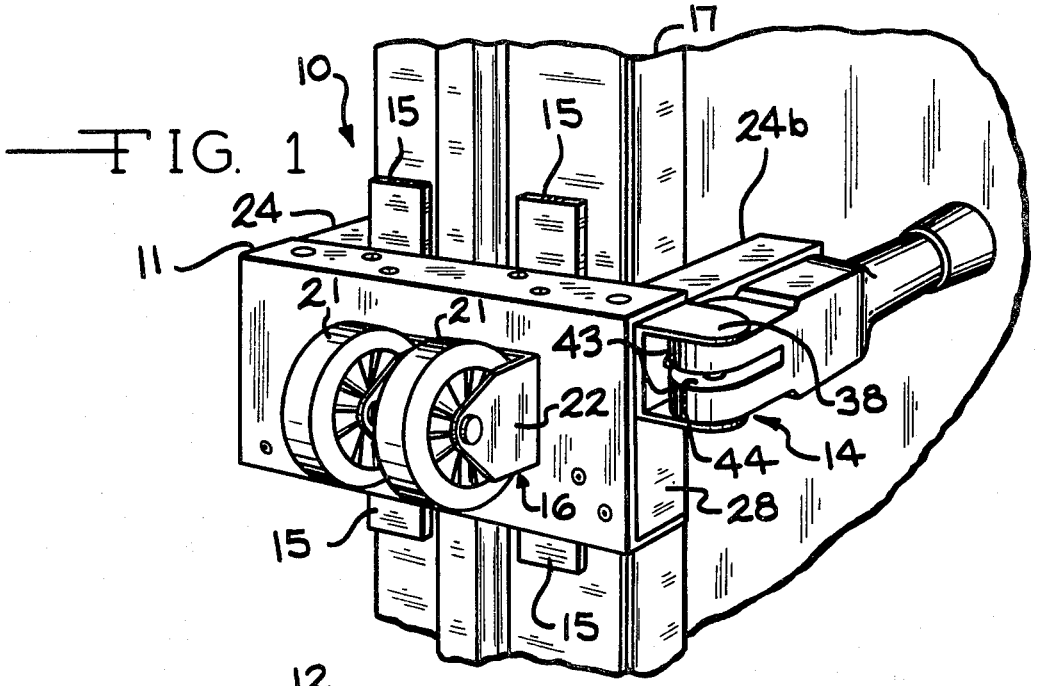
FIG. 1 is a perspective view of a spinal misalignment detective and corrective apparatus, according to the present invention, illustrating the apparatus attached to a vertial door jam.

Misalignment detective and corrective apparatus, according to the present invention, is generally indicated in the drawings by the reference number 10. The apparatus 10 is comprised of a base 11, support means 12, adjusting means 13, clamping means 14, stop means 15 and a wheel assembly 16.

Figure 4:
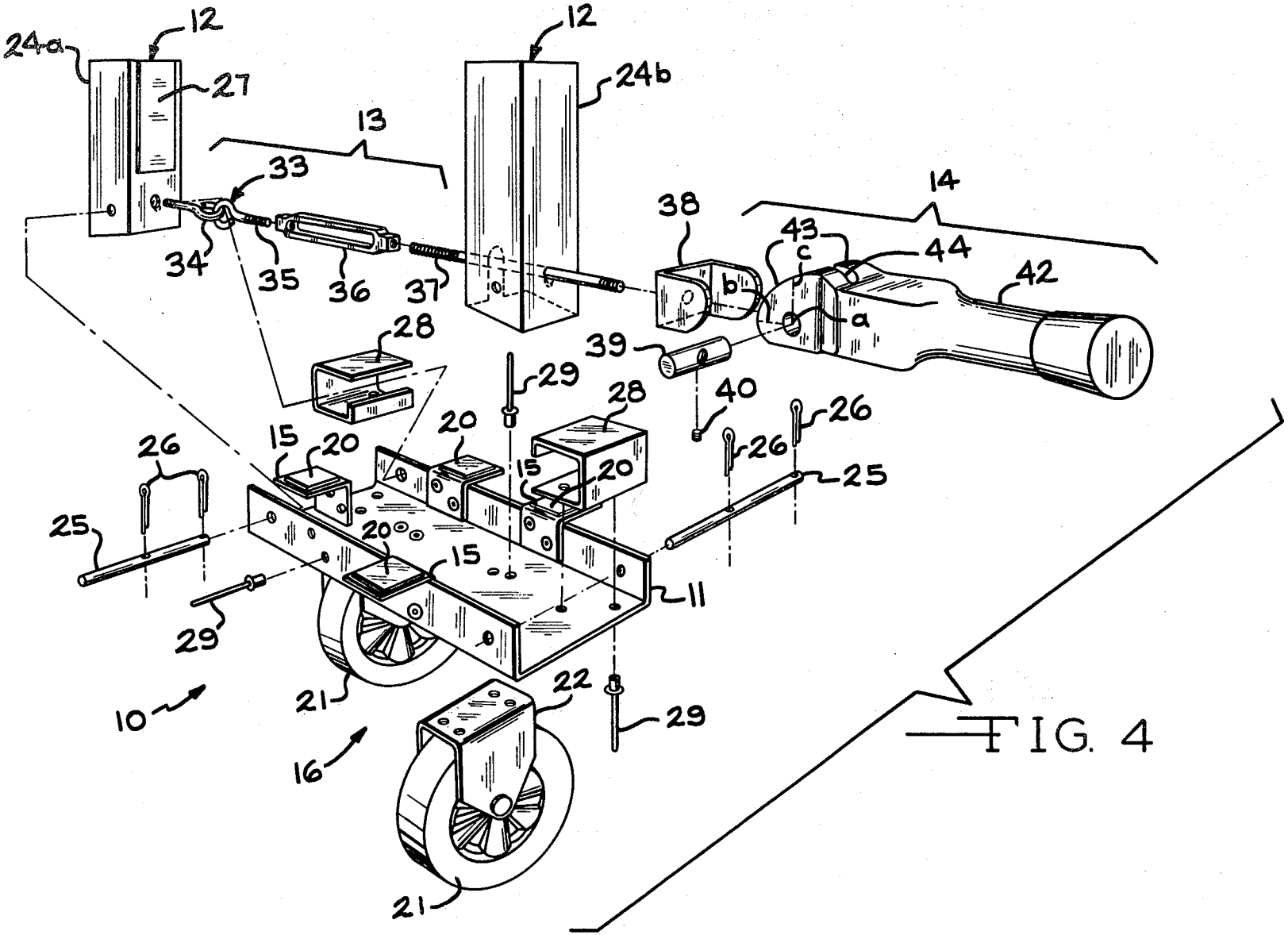
FIG. 4 is an exploded view of the apparatus shown in FIG. 1.

Referring to FIG. 4, the base member 11 consists of a section of C channel which is open at both ends. To this base member 11 are connected four stop brackets 15. The brackets 15 consist of right angle pieces which engage the vertically extending member and serve to restrict further movement of the apparatus 10. Connected to the outward side of the angular pieces are resilient cushions 20 which protect the vertically extending member 17, such as a door jam, when the apparatus 10 is engaged against the member 17.

Referring to FIGS. 1 and 4, attached to the side of the base member 11 facing outwardly from the vertically extending member is a wheel assembly 16. The wheel assembly 16, in the present embodiment, includes a pair of wheels 21 which are mounted by brackets 22. The brackets 22 are fastened to the outwardly facing side of the base member 11 by fasteners 29. The wheels 21 are spaced apart a pre-determined distance to allow the wheels 21 to straddle a person's spinal column. It should be noted that while the present embodiment of the invention includes a wheel assembly, other mechanisms such as rollers or ball and socket assemblies may also be used.

Figure 3:
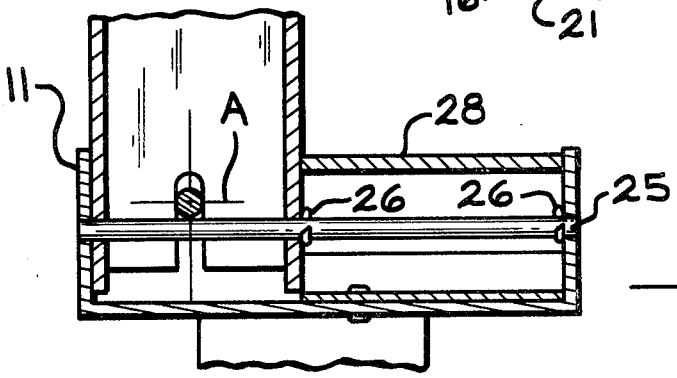
FIG. 3 is a cross sectional view taken along the line 3—3 of FIG. 2.

Referring to FIGS. 3 and 4, the support means 12 consists of two or more support arms 24 which are pivotally mounted to the base member 11 by means of axles 25 which are held in place by cotter pins 26. Attached to inner sides of the support arms 24 are resilient cushions 27. These cushions 27 protect the outer surfaces of the vertically extending member 17 when the apparatus 10 engages said member 17. To prevent transverse motion of the support arms 24 along the axes of the axles 25, C channel spacers 28 are positioned between the support arms 24 and the interior wall of the base member 11. The spacers 28 are attached to the interior base side of the base member 11 by fasteners 29.

Referring to FIG. 4, the adjusting means 13 consists of a misalignment fitting 33 comprised of two eyelet screws 34 and 35, a turnbuckle 36, a connecting rod 37 which is threaded at both ends, a support bracket 38, a rod 39, and a set screw 40. Eyelet screw 34 is attached to a support arm **24*a* and extends inwardly from said arm. The eyelet end of eyelet screw 35 is attached to the eyelet of eyelet screw 34. The threaded portion of eyelet screw 35 is threaded into the turnbuckle 36. One end of the threaded connecting rod 37 is attached to the opposite end of the turnbuckle 36. The connecting rod 37 passes through a relieved portion of the other support arm 24*b*, through a support bracket 38 and is secured to a rod 39 by a set screw 40. In FIG. 3, the axis "A" of the adjusting means 13 lies above and is perpendicular to the axles 25**.

Figure 2:
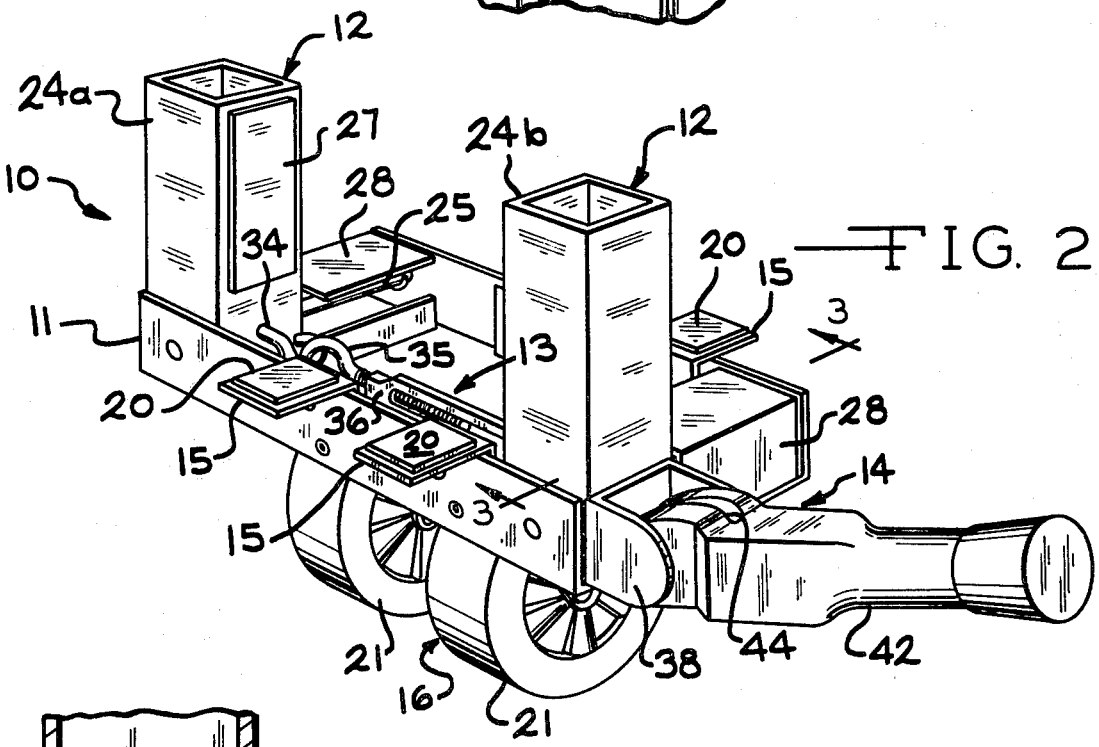
FIG. 2 is a view of the apparatus shown in FIG. 1 depicting the back portion of the apparatus including the support arms and the adjustment and stop means in a released position.

Initial engagement of the support arms 24 is achieved through use of the adjusting means 13. More particularly, turnbuckle 36 is rotated until the support arms snugly fit about the vertically extending member 17. Referring to FIGS. 1, 2, and 4, final engagement of the apparatus is achieved through use of a clamping means which includes a handle 42 with a cam end 43 and center relief section 44. The handle 42 is pivotally connected to the adjusting means 13 by the rod 39, which passes through the cam end 43 of the handle 42. The rod 39 has a rotational axis which is parallel to the rotational axes of the axles 25.

The cam end 43 of the handle 42 is designed so that when the handle is in the disengaged position, as illustrated in FIGS. 2 and 4, the portion of the cam with the minimum pitch line radius, indicated by line ab of FIG. 4, is adjacent to the support bracket 38. As the handle 42 is moved towards the support arms 24, the pitch line radius of the cam increases until the portion of the cam with the maximum pitch line radius, indicated by line ac of FIG. 4, is adjacent the support bracket 38, as illustrated in FIG. 1. Turning of the handle 42 causes the turnbuckle 34 to be drawn toward the handle 42 thus causing the distal portion of the support arms 24 to rotate inwardly, urging the apparatus 10 into a locked position against the outer surfaces of the vertically extending member 17. More particularly, the moving of handle 42 towards the support arms 24 causes moment arms to be created about the axes of the axles 25. The resultant moment arms cause the support arms 24 to move inwardly towards the vertically extending member 17. This creates the degree of tension necessary to retain the apparatus 10 in an engaged position against the outer surfaces of member 17.

Once the apparatus 10 is fixed by the user at the desired height above the floor, the user backs up to the apparatus 10 and positions his or her spine between the two wheels 21. The user then moves his or her back up and down while at the same time applying a reasonably constant force against the wheels 21. The up and down motion of the user can be achieved by bending at the knees and/or by raising the heels of the feet. As a result of the easy adjustment of the relative height of the apparatus, the user is individually able to quickly and effectively relieve the uneven spinal muscle tensions which are causing the user's discomfort.

Having described the invention in detail and with reference to the drawings, it is understood that such specifications are given only for the sake of explanation. Various modifications and substitutes, other than those cited, can be made without departing from the scope of the invention as defined by the following claims.

What I claim is:

1. A spinal misalignment detective and corrective apparatus for mounting on a vertically-extending door jamb member comprising, a base member, a wheel assembly extending from said base member for rotation on a horizontal axis, support means pivotally connected to said base member for removably holding said apparatus to such vertically extending door jamb member, said support means comprising a pair of outwardly-extending rectangular pivotally connected tube members and clamping means operatively connected to said support means for urging said tube members into the holding position on said door jamb.

2. Apparatus according to claim 1, wherein said base member includes resilient stop means for engaging and protecting such vertically-extending door jamb member.

3. Apparatus according to claim 2 wherein said clamping means is operatively connected to said support means, said clamping means including linkage means for adjusting said support means.

4. Apparatus according to claim 3, wherein said linkage means has one end connected to one of said tube members and its other end extending through the other one of said tube members.

5. Apparatus according to claim 4 wherein said clamping means is operatively connected to said support means, said clamping means including a handle assembly.

6. Apparatus according to claim 5 wherein said handle assembly is attached to said other end of said linkage means, said handle assembly including a cam, whereby a movement of said handle means urges the distal ends of said tube members to engage such vertically-extending door jamb member.

7. Apparatus according to claim 4 wherein said linkage means includes an adjusting assembly for adjusting the initial spacing between said tube members.

8. Apparatus according to claim 7 wherein said adjustment assembly comprises a turnbuckle.

9. Apparatus according to claim 8 wherein said turnbuckle includes a misalignment fitting.

10. Apparatus according to claim 1 wherein said wheel assembly has at least one wheel.

11. Apparatus according to claim 1 wherein said wheel assembly includes one or more pairs of wheels.

12. A spinal misalignment and corrective apparatus for mounting on a vertically-extending door jamb member and comprising, a base member, a pair of wheels extending outwardly from said base member and mounted for rotation on a horizontal axis, support means operatively connected to said base in opposed relationship to said pair of wheels for removably holding said apparatus to such vertically-extending door jamb member, said support means including a pair of outwardly-extending rectangular tube members pivotally mounted on said base member, the distal ends of said tube members being moveable toward one another to engage such vertically-extending door jamb member, resilient stop means on said base member for engaging and protecting such vertically-extending door jamb member, and clamping means operatively connected to said tube members, said clamping means including linkage means having one end connected to one of said tube members, said linkage means extending through the other of said tube members and operatively connected to a handle assembly, said handle assembly including a cam and handle means, whereby movement of said handle means urges the distal ends of said tube members to engage such vertically-extending door jamb member, said linkage means including adjusting means for adjusting the initial spacing between said tube members.

* * * * *